US005812273A

United States Patent [19]

Conley et al.

[11] Patent Number: 5,812,273

[45] Date of Patent: Sep. 22, 1998

[54] OPERATION SCHEDULING SYSTEM FOR A DIGITAL PRINTING APPARATUS, USING A TABLE OF EXECUTED OPERATIONS TO REVISE A SCHEDULE IN REAL TIME

[75] Inventors: John H. Conley, Rochester, N.Y.; Markus P. J. Fromherz, Palo Alto, Calif.; Susan B. Layer, Fairport, N.Y.

[73] Assignee: Xerox Corporation, Stamford, Conn.

[21] Appl. No.: 787,505

[22] Filed: Jan. 21, 1997

[51] Int. Cl.[6] ..... G03G 15/00

[52] U.S. Cl. ..... 358/296; 399/364; 358/468

[58] Field of Search ..... 358/296, 401, 358/468; 399/16, 364, 401; 347/1.1

[56] References Cited

U.S. PATENT DOCUMENTS

| | | | |
|---|---|---|---|
| 5,095,342 | 3/1992 | Farrell et al. | 399/401 |
| 5,504,568 | 4/1996 | Saraswat et al. | 355/308 |
| 5,528,375 | 6/1996 | Wegeng et al. | 358/296 |
| 5,557,367 | 9/1996 | Yang et al. | 355/202 |
| 5,596,389 | 1/1997 | Dumas et al. | 399/16 |

*Primary Examiner*—Peter S. Wong
*Assistant Examiner*—Gregory J. Toatley, Jr.
*Attorney, Agent, or Firm*—R. Hutter

[57] ABSTRACT

In a system for scheduling a sequence of operations in an apparatus for outputting, for example, simplex and duplex digitally-printed documents, a schedule is derived for obtaining a desired output order of documents, and this schedule is proposed to the apparatus in real time. As individual operations are accepted for execution by the apparatus, the accepted operation is recorded in an execution table. If a proposed operation is rejected by the apparatus, the execution table can be used to revise the schedule quickly to take into account the rejected operation while still obtaining the desired output order.

6 Claims, 7 Drawing Sheets

60

| 62 LAST | 64 add s | | 66 add f- - -d | |
|---|---|---|---|---|
| | next | offset | next | offset |
| 1 | 3<br>5<br>9 | 0<br>1<br>2 | 10<br>5<br>14 | 2<br>3<br>4 |
| 2 | 4<br>7<br>10 | 0<br>1<br>2 | 11<br>15<br>13 | 2<br>3<br>4 |
| 3 | 5<br>12<br>8 | 0<br>1<br>2 | 12<br>16<br>14 | 2<br>3<br>4 |
| •<br>•<br>• | •<br>•<br>• | •<br>•<br>• | •<br>•<br>• | •<br>•<br>• |
| 16 | 11<br>14<br>1 | 0<br>1<br>2 | 9<br>11<br>13 | 2<br>3<br>4 |

FIG. 3 PRIOR ART $sd_1d_2$

| SCHEDULE | EXECUTION |
|---|---|
| ---s | $f_1$ ---$d_1$ |
| $f_1$ --$sd_1$ | $f_1f_2$ --$d_1d_2$ |
| $f_1f_2$ -$sd_1d_2$ | $f_1f_2$ -$sd_1d_2$ |
| $f_2$ rejected: reschedule from last valid execution | |
| $f_1$x-$sd_1$ ← | $f_1$x--$d_1$ |
| $f_1$x-$sd_1f_2$ ---$d_2$ | |

FIG. 6

OPERATION SCHEDULING SYSTEM FOR A DIGITAL PRINTING APPARATUS, USING A TABLE OF EXECUTED OPERATIONS TO REVISE A SCHEDULE IN REAL TIME

CROSS-REFERENCE TO RELATED APPLICATION

Cross-reference is made to the following co-pending U.S. patent application, Ser. No. 08/787,188, entitled "Operation Scheduling System for a Digital Printing Apparatus, Using a Tree of Possible Schedules."

INCORPORATION BY REFERENCE

The following U.S. patent is incorporated by reference: U.S. Pat. No. 5,504,568, issued Apr. 2, 1996, assigned to the assignee hereof.

FIELD OF THE INVENTION

The present invention relates to a system for controlling a printing machine capable of producing single-sided (simplex) and double-sided (duplex) prints, or more generally to scheduling operations in systems where the output depends on the time-sequence of operations performed by the apparatus. Specifically, the present invention relates to recovery techniques for re-scheduling such operations when an originally-proposed schedule is rejected by the apparatus.

BACKGROUND OF THE INVENTION

On-demand page printers, wherein images are created in response to digital image data submitted to the printing apparatus, are familiar in many offices. Such printers create images on sheets typically using electrostatographic or ink-jet printing techniques. In work-group situations, wherein different users at various personal computers and other terminals submit jobs to a single central printing apparatus, various sets of digital image data, corresponding to jobs desired to be printed by different users, are typically kept in an electronic queue, and a control system typically located at the printer sorts through the image data and causes the printer to output the desired prints in an orderly manner.

Particularly with sophisticated printing apparatus, it may often be desired to print "duplex" prints, that is prints having images on both sides of the sheet. However, just about every currently commercially available printing apparatus is capable of producing an image only on one side of a sheet at a time. In order to obtain duplex prints, it is almost always necessary to provide an "inverter" within the printing apparatus. The purpose of an inverter is to handle a sheet after one side thereof has received an image, and in effect turn the sheet over to make the remaining blank side available to the same printing apparatus which created the first image. In effect, each duplex print is re-fed past the image-making portion of the printing apparatus so that the individual sheet becomes available to the image-making apparatus twice, once for each side.

A long-standing concern of designers of printing apparatus is how to optimize the use of a printing apparatus for situations wherein some desired prints are simplex and others are duplex. The fact that each duplex print has to be printed essentially twice causes a significant systemic problem with maintaining optimal or near-optimal operation of the entire printing apparatus. One simple solution, for example, would be to run every sheet along the duplex path, regardless of whether it is a simplex or duplex print, and in the case of each simplex print simply print nothing on the back side. While this solution is easy to implement, it provides the disadvantages of unnecessarily decreasing the output speed of the whole system. Another solution is to maintain duplex prints which are awaiting printing on the back sides thereof in a special buffer tray, until the system becomes available for printing the back sides of each sheet in sequence. The key disadvantage of this system is that a significant probability of error exists (a sheet may have the incorrect back side image placed thereon), and also the relatively intense handling of each print sheet in and out of the buffer tray substantially increases a likelihood of mechanical misfeed. Both such problems tend to result from the fact that sheets typically cannot be fed out of the buffer tray reliably. Even with a buffer tray, a fairly sophisticated scheduling system is required.

In electrostatographic printing apparatus, wherein images are first created on a photoreceptor in the form of a rotating drum or belt and then transferred to sheets, a key concern is the presence of blank pitches (image-sized spaces) along the drum or belt where, for various reasons relating to duplexing, no image is created. The problem with blank pitches is that each blank pitch represents lost productivity. In some duplexing schemes, the number of blank pitches along the belt may be comparable to the number of pitches actually having images on them. In such a situation, not only is the apparatus effectively running at half-speed, but various mechanical parts associated with the drum or belt will be experiencing wear to no productive purpose. Thus, as a general rule, the overall productivity of such printing apparatus is closely related to the number of blank pitches which result in the printing process.

DESCRIPTION OF THE PRIOR ART

U.S. Pat. No. 5,528,375 discloses an implementation of scheduling page-side images in a high-volume electrophotographic printer capable of outputting simplex and duplex prints. The method includes the steps of building a scheduling list indicating an order in which images in the job are to be printed. An indication can be provided in the scheduling list when image data for a particular image is available in memory.

U.S. Pat. No. 5,557,367 discloses a method of scheduling the operation of hardware modules in a duplex printing apparatus, using a system of accumulating constraints which satisfy criteria associated with a particular print job.

SUMMARY OF THE INVENTION

According to the present invention, there is provided a method of developing a schedule for operations in an apparatus for outputting prints. A schedule space defining a series of pitches is provided, the apparatus being capable of performing an operation within each pitch. For each print to be output, a block indicative of the apparatus outputting the print is provided to the schedule space. A series of operations are proposed to the apparatus according to a schedule of blocks in the schedule space, each block corresponding to a pitch to be executed at a predetermined time in the future. An execution space defining a series of pitches is provided. If a proposed operation is accepted by the apparatus, the block representing the operation is provided to the execution space in real time.

According to another aspect of the present invention, there is provided a method of developing a schedule for operations in an apparatus for outputting prints. A schedule space defining a series of pitches is provided, the apparatus being capable of performing an operation within each pitch.

For each print to be output, a block indicative of the apparatus outputting the print is provided to the schedule space. A series of operations are proposed to the apparatus according to a schedule of blocks in the schedule space, each block corresponding to a pitch to be executed at a predetermined time in the future, a time period between scheduling of a pitch in the schedule and execution of an operation in the schedule being defined as a time range. If there is no block scheduled in a given pitch entering the time range, scheduling of a block in said given pitch is prevented.

As used in certain of the claims herein, print sheets will be referred to as either "simplex" or "complex" documents. In the present description of a preferred embodiment of the present invention, the method of the present invention is applied to the creation of duplex sheets, that is, sheets having a first image printed on one side and a second image printed on another side. However, in other possible embodiments of certain of the claims hereinbelow, the claimed principles could be applied to other printing tasks in which multiple images are printed on a sheet, such as when different primary-color images are printed on the same side of a sheet to yield a full-color image. For this reason, what is described as "duplex blocks" in the specification can be generalized to "complex blocks" in the claims.

BRIEF DESCRIPTION OF THE DRAWINGS

FIG. 3 is a portion of an example "transition table" as used in one embodiment of the present invention;

FIG. 6 is a set of comparative tables illustrating the different functions of a schedule and an execution table, according to one aspect of the present invention.

DETAILED DESCRIPTION OF THE INVENTION

A. Duplex Printing Apparatus

Figure 1:
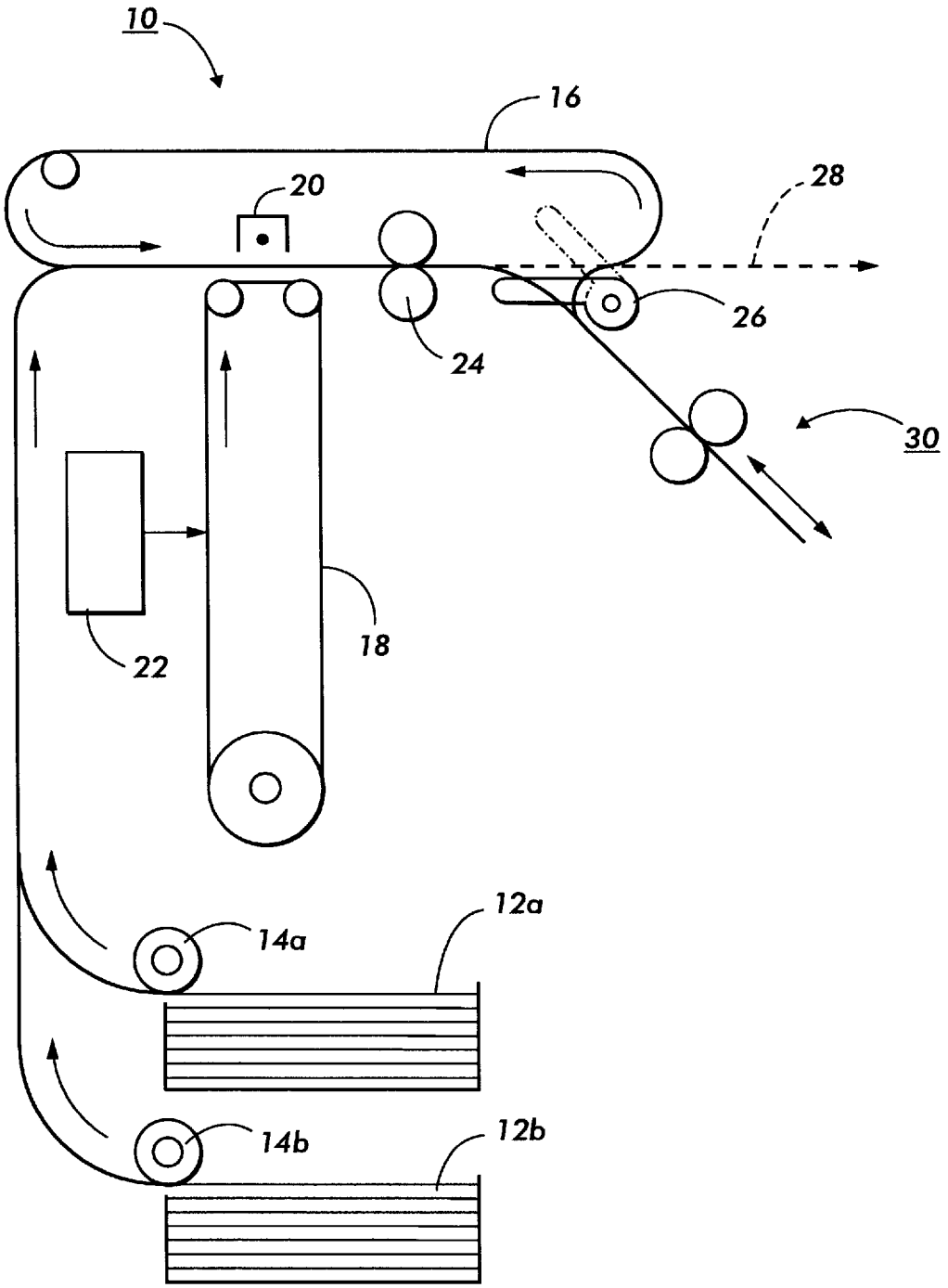
FIG. 1 PRIOR ART
FIG. 1 is a simplified elevational view showing the relevant parts of a duplex printing apparatus, on which the system of the present invention may operate.
Figure 2:
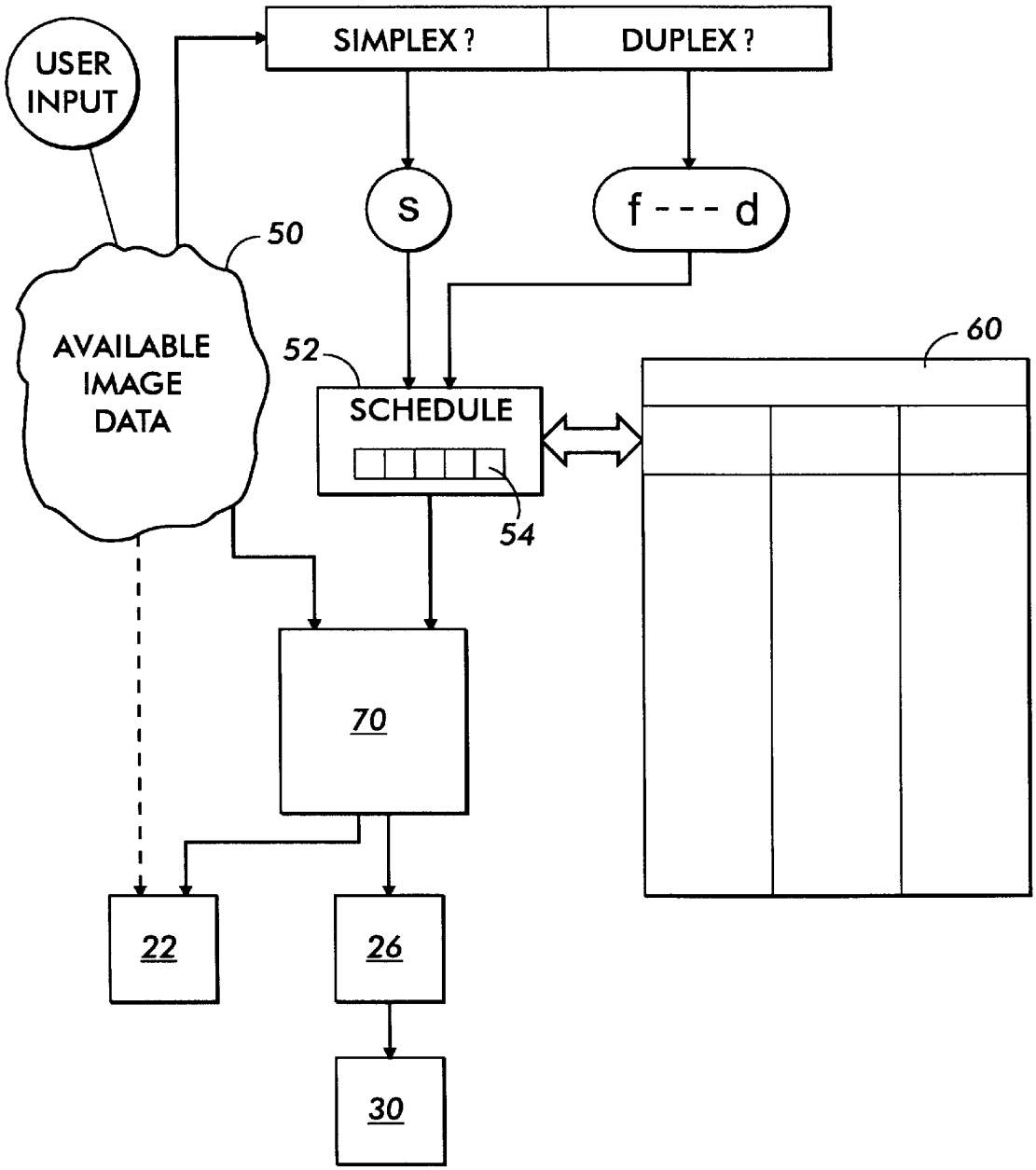
FIG. 2 PRIOR ART
FIG. 2 is a systems diagram showing the essential parts of the control system of the present invention.

FIG. 1 is a simplified elevational view of the paper path of an on-demand printing apparatus, capable of simplex or duplex output, in which a stream of digital video signals representative of images desired to be printed causes the desired images to be formed on a selected side of a print sheet. The particular architecture shown in FIG. 1 is for an electrostatographic printer, but it will be understood that the principle of the invention could apply equally to other types of image-creation technologies, such as ink-jet printing. The printing apparatus, generally indicated as 10, contains one or more stacks of available sheets on which to print images, these stacks being indicated as 12*a* and 12*b*. The sheets of paper in the stacks 12*a* and 12*b* may differ in, for example, size, color, or the presence of a pre-printed letterhead. When it is desired to create an image on a sheet, a sheet of a desired type is drawn from a stack such as 12*a* or 12*b*, such as by respective feeders 14*a*, 14*b*, and the individual sheet is fed onto duplex loop 16.

Duplex loop 16 is typically in the form of an endless belt which is capable, by means of friction, static electricity, vacuum, or other means, of retaining a plurality of sheets thereon, thereby retaining a particular sheet until it is time for the sheet to receive an image on the side of the sheet facing outwardly from the belt of the duplex loop 16. In the architecture shown in FIG. 1, it is intended that sheets "ride" on the outer surface of the belt of duplex loop 16. Along one portion of duplex loop 16, the belt of duplex loop 16 comes into close contact with a photoreceptor belt indicated as 18. At the point of close proximity of duplex loop 16 and photoreceptor belt 18, there may be provided a transfer corotron 20, the function of which will be familiar to one of skill in the art of xerography.

In the xerographic-based embodiment of a printing apparatus shown in FIG. 1, a device which shall be here generally referred to as an "imager" creates an electrostatic latent image on the surface of photoreceptor 18. Imager 22 has the function of receiving a sequence of digital signals representative of the desired image to be printed, and outputs a physical manifestation, such as a modulated laser scanning beam, to imagewise discharge selected areas on the photoreceptor 18 to create an electrostatic latent image representative of the image desired to be printed. As is known in the art of electrophotography, other stations along the path of photoreceptor 18, such as a charging bar and development unit (not shown) are also required to create the desired developed image on the photoreceptor belt 18. This developed image, which is typically in the form of a reverse image in toner particles on the photoreceptor 18, is then made available to a sheet which rides on the outer surface of duplex loop 16.

After an image is created on the photoreceptor belt 18 by imager 22, and developed (by means not shown), the motion of photoreceptor belt 18 causes the developed toner image to be in close proximity or in contact with a sheet, originally from stack 12*a* or 12*b*, which is riding on the outer surface of duplex loop 16. At transfer corotron 20, the toner particles arranged in imagewise fashion on photoreceptor 18 are electrostatically transferred to the surface of the sheet by transfer corotron 20. Soon thereafter along the path of duplex loop 16, the toner image on the sheet is passed through a fuser 24, which causes the toner image to be fixed permanently on the outer surface of the sheet, in a manner known in the art. Thus, immediately downstream of fuser 24, there will be created a sheet having a desired image on the side thereof which faces outward along the duplex loop 16. If at this point the sheet having the image thereon is desired to be output from the system, a device such as router 26, a simple design of which is shown in FIG. 1, but which may be of any number of designs known in the art, will cause the sheet to be disengaged from the duplex loop 16 and output from the printer such as through the path indicated by arrow 28. This output sheet can either be directly output into a tray for pickup by the user, or may be sent to a sorting or stapling device according to the larger architecture of the printing apparatus.

To create a duplex print, that is, a print having one desired image on one side thereof and another desired image on the other side thereof, it is necessary to make the other side of the sheet available to the photoreceptor belt 18, by causing the other side of the sheet to face outward while the sheet rides on the outside of duplex loop 16. For this purpose there is provided along the duplex loop 16 a device generally indicated as inverter 30. The basic purpose of inverter 30 is to pick off a sheet from duplex loop 16 which has an image already placed on the outward-facing side thereof, and in effect turn the sheet over so the other, "non-printed" side of the sheet faces outward as duplex loop 16 re-feeds the sheet for another cycle so that photoreceptor belt 18 can place another desired image on the other side thereof. In brief, inverter 30 operates by temporarily removing the sheet from the duplex loop, feeding it in one direction, and then re-feeding it back onto the duplex loop 16, such as indicated by the double-headed arrow next to inverter 30. Various designs of an inverter 30 are available to one of skill in the art. Once again, the purpose of the device shown as router 26 would be to selectably cause the sheet to be output along path 28, or to enter inverter 30, depending on whether the particular sheet passing therepast is a simplex print, the first side of a duplex print, or the second side of a duplex print.

Returning to imager 22, it will be evident that the stream of video signals being entered into imager 22 must relate to the desired sequence of simplex and duplex images to be created on photoreceptor 18 and ultimately transferred to one side or another of the sheet being fed along duplex loop 16. The physical configuration of duplex loop 16 mandates that the images placed on sheets around the duplex loop 16, and therefore images placed on photoreceptor belt 18 by imager 22, must be placed in an order such that, for a duplex print, an image placed on one side of a particular sheet at one time will determine when the inverted sheet is available for placement of a desired image on the other side of the sheet.

It will be noted that the specifically electrostatographic aspects of the apparatus shown in FIG. 1, such as the photoreceptor 18, imager 22, and transfer corotron 20, could be replaced by equivalent apparatus for other techniques for creating images on one side of a sheet, such as an ink-jet printhead. Also, imager 22 as here described assumes that the user has unlimited control over the order of page images (the "digital video") being output through imager 22. If, however, the original source of images to be created is itself a set of automatically fed hard-copy images, i.e. if the printing system as a whole is operating as a copier, the feeding of originals will also create certain constraints on the optimal order of images created with the printer. It is probably preferable to digitize (convert to digital signals) the original hard-copy images, electronically store the resulting data, and apply the data as required to a digitally-based imager 22.

In the particular embodiment shown in FIG. 1, it is evident that, after a front-side image is placed on a sheet at transfer corotron 20, this sheet is picked off duplex loop 16 by router 26, inverted by inverter 30, and placed back on duplex loop 16, where the inverted sheet will again become available to receive an image from photoreceptor 18 at a time in the future after the inverted sheet makes its way around duplex loop 16. Thus, for a duplex print, the creation of the front-side image by imager 22 must be spaced by a fixed time period from the creation of the back-side image on the same sheet; this time difference is ultimately dependent on the size of the sheet relative to the overall length of the duplex loop 16. Given a fixed-speed paper path, the only sheet-size-related difference is due to the inverter 30; if a longer sheet has to be driven farther into inverter 30 to invert the sheet, the extra length in and out of inverter 30 changes the length of the duplex path. If the duplex loop 16 is longer, will be more time will be required for the back side of the sheet to come around to photoreceptor 18, and therefore a longer time spacing would be required between the outputting of the front-side image from imager 22 and the back-side image.

In a practical application of a duplex printer, an operating parameter which is more useful than the timing between the production of particular images is the number of "pitches" along the length of either the photoreceptor belt or the duplex loop. A "pitch" is a length of the duplex loop or photoreceptor belt corresponding to an image of the size to be printed, such as 8.5×11 inches or "A4". For example, a typical practical length of a duplex loop 16 is four pitches; that is, for letter-sized images to be printed, the duplex loop 16 is of a length wherein four such images, or four such sheets, could be retained on the duplex loop 16 at a particular time along the circumference thereof. What this also means is that duplex loop 16 is capable of, in effect, temporarily storing up to five such sheets at a time between the time any individual sheet receives an image on one side thereof and gets ready to receive an image on the other side thereof. This "capacitance" of the duplex loop 16 will of course have a direct effect on the spacing, and number of pitches, between the output of a front-side image by imager 22 and a back-side image for the sheet from imager 22. It will also be apparent that, if a larger size print, such as 11×17 inches, is desired to be printed, the effective capacitance of duplex loop 16 will be lower, such as two or three pitches, because only two or three such large sheets could be retained along the circumference of duplex loop 16 at a particular time.

B. Scheduling of Simplex and Duplex Prints

Having explained the physical parameters of a duplex-capable printing apparatus capable of being optimally controlled by the system of the present invention, attention is now directed to the specific techniques according to the present invention. In a networked printing environment, it is likely that any number of a large population of users may at any time access the printer 10 for printing of various jobs which may be duplex, simplex, or a combination of the two. As mentioned above, for efficient long-term use of the printer 10, it is desired that this incoming stream of jobs to be printed be organized such that a minimum of the resources of the printer 10 are wasted. In practical terms, this optimal usage translates into a minimal use of blank pitches along the length of photoreceptor 18. Any blank pitch along photoreceptor belt 18 represents a wasted resource, in that a blank pitch could conceivably have been put to use in producing a desired image. It is a key function of the system of the present invention to create an optimal schedule of images to be output by imager 22 to optimize the function of the entire printing apparatus 10.

In order to perform this scheduling function, according to the present invention there is provided a data structure, such as a portion of computer memory, which retains instructions for the imager 22 on which of an available set of images to be printed are to be printed at a given time and in what sequence. In this available memory space, a schedule is constructed in an ongoing manner. This schedule is a continually-changing list of which page images will be placed on the photoreceptor 18 by imager 22 in the immediate future.

According to the present invention, every time a request to print a simplex or duplex sheet is received by the control system of the printing apparatus, there is entered into the schedule a "block" corresponding to the print desired to be printed. The nature of this block will depend on whether a simplex or a duplex print is desired. For a simplex block the imager 22 is concerned with the printing of only one image, and therefore the schedule need require a unitary block, which can be rendered as s. For every duplex print desired to be printed, the block entered into the schedule will have two parts, representative of the front (f) and back (called d, in reference to being the final image in the duplex print) image on the same sheet. This "duplex block" will appear as something like f - - - d, with the dashes representing available empty pitches between the creation of the front image f and the back image d.

The duplex loop length is the distance from start of the front page to start of the back page. In the particular example shown, the duplex block f - - - d corresponds to a duplex loop 16 having four pitches; after the front image f is created, the imager 22 must wait for three blank pitches to print the back image d.

If, for example, the relative sizes of the images to be printed and the duplex loop were seven pitches per duplex loop, the duplex block may look like f - - - - - - d, and if the duplex loop were three pitches in length, the duplex block would look like f - - d. The varying total length (in pitches) of the duplex block relates directly to how long a sheet will travel on duplex loop 16 before it moves past the transfer corotron 20 again to receive another image.

In determining how many pitches exist between the f and d blocks within the duplex block, other physical considerations may have to be taken into account, such as the amount of leftover space when documents of a particular size are placed on the duplex loop. If sheets of different sizes are desired to be mixed along the duplex loop, it might be necessary to assign a finite length to a block or a portion of a block: for instance an 11×17 sheet will in effect take up two "normal" 8.5×11 pitches on the duplex loop, and the blocks representative thereof must reflect this. Also, the position and behavior of the inverter may also have an effect on the exact nature of different duplex blocks; for example, the time spent for a sheet entering and exiting the inverter 30 may have the effect of adding one or more pitches along the duplex loop 16.

Taking the four-pitch embodiment of a duplex loop as the example, it will be noted that the three blank pitches between the f and d images in the duplex block are potentially available for the creation of images of other prints. These blank pitches appear not only along the circumference of the duplex loop 16, but also the photoreceptor belt 18. If the blank pitches between the f and d blocks for each duplex image can be utilized to print other pages, fewer blank pitches will be necessary and therefore the system as a whole will be faster and more efficient. Thus, if one wished to print three consecutive duplex prints, one could concatenate the three f - - - d blocks as f f f - d d d. By having the imager 22 output the sequence of images in this way, almost the full capacitance of the duplex loop is utilized, with only the one blank pitch in the middle being required to maintain the proper spacing between the f and d of each f - - - d block.

When producing a mix of simplex and duplex prints, either within a single job, or where one type of job immediately follows a job of the other type, it will also be possible to insert simplex images in the blank pitches between the f and d images of a duplex job, such as to create a sequence f - s s d. As it happens with the particular hardware architecture shown in FIG. 1, the requirements of the inverter 30 are such that a simplex print s cannot immediately follow the creation of a portion of a duplex print f or d. Thus, in the sequence of prints output by the printer 10, and thus also by imager 22, the sequences f s and d s are physically impermissible. Further, in one embodiment of a printing apparatus similar to that shown in FIG. 1, the sequence f d is physically impermissible as well. These physical constraints on certain sequences can be built into the control system of the present invention, in a manner which will be described in detail below.

To take an example of combined simplex-duplex printing for a particular job, consider a case in which the desired output is a simplex print, followed by a duplex print, then another simplex print, and finally another duplex print; or in shorthand s d s d. It will be noted that every ultimate output of the printer 10 must be either a simplex print s or the second side d of a duplex print. In this case, one best solution to the problem of assigning photoreceptor and duplex loop pitches in the printer would be to have the imager 22 output the images as f - - sdf - s - d. It will be noted that this sequence of prints retains the sdsd final sequence of desired print outputs, while also preserving the f - - - d spacing between duplex images, and also avoids the impermissible f s, d s, and f d sequences which are prohibited by the physical structure of the inverter 30. Incidentally, to take another example of another physical architecture, wherein the fd sequence happened to be permissible, then an even more efficient (i.e., fewer blank pitches) sequence would be possible: f - sfd - sd. Once again, the sdsd sequence of prints as they are output is here preserved. It is the function of the optimization step of the present invention to obtain the most efficient sequence of s, f, and d image creation given a particular desired final output of simplex and duplex prints such as s d s d.

Because in the networked-printer context, requests for printing various simplex or duplex prints will enter the control system essentially randomly, an optimization technique for determining the most efficient sequence of f, d, and s images will have to reassess the most efficient sequence given both its current state of prints it has already committed to making, and the addition of each new print which is desired to be printed. Generally, different embodiments of the present invention rely on one or both of the following optimization techniques: the "greedy-algorithm" technique, and the "forward reach-back" technique. The greedy-algorithm technique can further be divided into a forward greedy-algorithm technique and a backward greedy-algorithm technique.

C. Basic Scheduling Techniques

Turning first to the "reach-back" technique for creating an optimal sequence of image creation, it should be noted that, given a block and a schedule, the block can only reach back into and affect the schedule up to a finite length. In other words, in the example where, because of the length of the duplex loop 16 and the size of the desired prints, only four sheets may be retained along the circumference of duplex loop 16 at any time. Therefore, a control system which is scheduling prints on an ongoing basis, upon receiving a request to do another print, can "reach back" four pitches or images into the existing schedule from imager 22 in order to insert a new simplex or duplex block for the latest requested print.

With the reach-back optimization technique, the control system looks at the present allocation of the last four pitches in the currently-scheduled list of images to be created and then determines whether or not the new s (for a simplex image requested) or f - - - d (for a duplex print requested) can be placed at a given offset, taking into account both the requirement of adding a minimum number of blank pitches, and also the physical constraints such as avoiding the f s, d s, or f d sequences. As used herein, the term "offset" refers to the selection of which available blank pitch receives the new block added to the schedule. For example, when scheduling in the forward direction, if the end of the schedule is f - - - d, a new s could be added at zero offset to make the new ending f - - - d s, while placing the s at offset one would make the schedule f - - - d - s, and placing the s at offset two could make the schedule f - - - d - - s. The significance of the "offset" concept will become apparent as the invention is described in detail below.

A central idea behind the present invention is that every new block added to an ongoing schedule is fit into the end of the sequence of prints to be made, with the number of possible variations to the schedule being less than or equal to the number of pitches in the reach-back. What makes the forward reach-back work is that it proactively accounts for blocks that might get placed in the schedule later. For example, if the last pitch spaces in the sequence are f - - - d, a subsequent block could fit into four possible blank spaces (i.e., one of the blank pitches within the block, or a position after the end block). But when successive blocks are scheduled, the number of possible ways of scheduling numerous successive blocks increases exponentially. What keeps the scheduling manageable with the present invention is that the number of variations is limited by the length (number of pitch spaces) of the reach-back; thus, only a manageable number of schedule variations need be considered at any time.

When determining where to place the block (either s or f - - - d) for the latest-requested print, the optimization system will first look at what pitch spaces are available in the last scheduled pitch spaces within the reach-back, in this example in the last four pitch spaces. If there are blank spaces within the last scheduled pitch spaces, it would be desirable to insert an f image in one of those blank pitch spaces, if possible, consistent with the physical constraints. As it happens, in this particular embodiment, the configuration of available blank letter-size pitch spaces in the last four scheduled pitch spaces can be of one of only 16 possible configurations; that is, at any time in the course of printing a stream of prints, the last four pitches in the schedule can be configured in only 16 ways. When either an s or an f - - - d, representing a newly-requested simplex or duplex print, is added at the end of the schedule, at the given offset, the new end will simply change to another of the 16 possible endings of the schedule. Addition of another s or f - - - d request will result in another transition from one ending of the 16 to another ending of the 16; the response of one possible ending to either a simple or duplex request (at a given offset) will always remain in the closed system of 16 possible endings.

With this in mind, a "transition table" can be constructed, in which the 16 possible endings of the last four pitch spaces in the schedule, numbered 1–16, exist in one column while in a second column exists the lists of endings that result when an s print request is added to each of the endings, at each of the possible offsets. In another column are the lists of endings that result when an f - - - d request is added onto a given ending in the first column, at each of the possible offsets. The last two columns will have no more than the same set of numbers 1–16 as the first column, but in a different order. For example, if we start with an arbitrary ending numbered 1, addition of an s at offset 0 may result in a new ending which is identical to ending 16 in the initial list, while an optimal addition of f - - - d at offset 0 may result in a new ending identical to another numbered ending in the original list. If the s is in fact added to ending 1, the next iteration will start with ending 16 in the first column and then go on with a new ending from within the same list of 16, depending on whether the next print request is an s or an f - - - d. Significantly, the new ending will always be within the original set of 16 possible endings. This closed system is the "transition table" by which, when the inputs are the current configuration of available pitch spaces at the last four pitches of the schedule and the type of requested new print, either s or f - - - d, the output will be a new ending from the list of 16 possible endings, and will serve as the input for the next iteration.

To reiterate briefly another technique described in the patent incorporated by reference, the creation of a schedule of prints to be output can be derived from a "greedy algorithm." Taking for example a task of printing first a simplex sheet s and then outputting a duplex sheet f - - - d, a "greedy algorithm" scheduling technique would cause the printing apparatus to output the images as they are requested, starting the printing of the image as early as possible. Thus, in order to output the desired sd sequence, the greedy algorithm technique would first cause the printing of the simplex s and then immediately start printing the f - - - d, yielding total scheduling of sf - - - d. It will be noted that this greedy algorithm technique, in this example, "wastes" three pitch spaces which are doing nothing.

According to a reachback technique, in contrast, the schedule for outputting the desired sequence of sd would be f-s-d, which "wastes" only two pitch spaces.

As mentioned in the patent incorporated by reference, however, even though reachback techniques very often yield significantly better results than a greedy algorithm technique, in certain common situations, the greedy algorithm technique, which consumes significantly less computing time while prints are being output, yields results which are as good as almost as good as those obtained with a reachback technique. The most obvious manifestation of this would be a long job of simplex-only sheets, which will always yield a chain of sss . . . , and therefore would make a reachback scheduling technique unnecessary.

D. A Detailed Implementation

Figure 4:
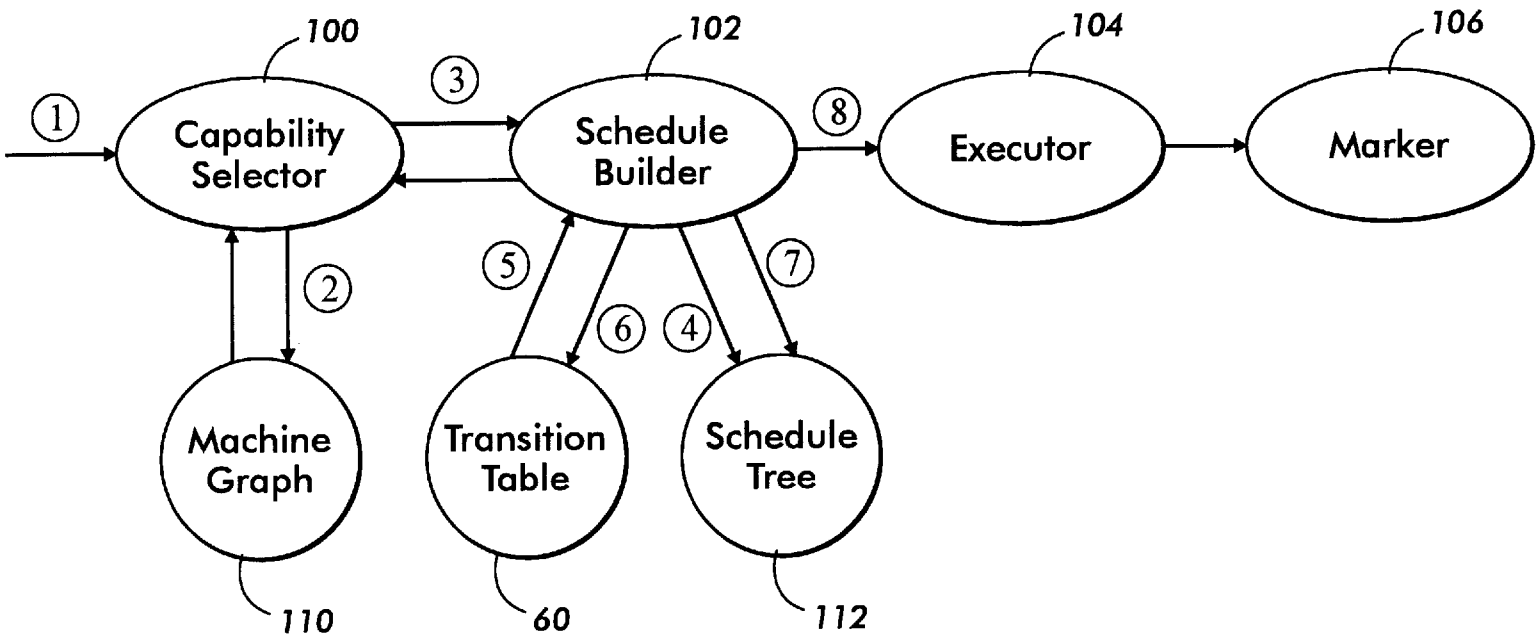
FIG. 4 is a diagram showing the interaction of various software entities in the control system of the present invention, when images to be printed are being successfully scheduled.

FIG. 4 is a diagram showing the basic principles of creating an optimized schedule in a duplex printer such as shown in FIG. 1, in greater real-time detail than shown in the original patent incorporated by reference. FIG. 4 shows the interaction of various software entities, the function of each of which will become apparent in the discussion below. The basic software entities of a capability selector 100, a schedule builder 102, and a schedule executor 104, the last of which is a direct connection to the marker 106 which directly controls, for example the imager 22 shown in FIG. 1, as well as other hardware modules, such as feeders 14*a*, 14*b*, router 26, etc. The capability selector 100, schedule builder 102, and schedule executor 104, in turn, interact with other software utilities, such as a machine graph 110, transition table 60 (the function of which has been described above), and a schedule tree 112, the last of which is basically a memory for retaining a list of options for future scheduling given a certain number of previous blocks placed in the schedule.

Going through FIG. 4, in a basic, uninterrupted case where a print job having various simplex and/or duplex sheets are to be printed, the operation of the various software entities is as follows. The information relating to the job to be printed, which will specify a certain number of duplex and/or simplex sheets to be output, is entered into capability selector 100 (step (1) as shown in FIG. 4). The capability selector 100 then refers to a piece of software known as "machine graph" 110, at step (2), to derive from the original job information a "capability" for the job. In general, the capabilities for a job are commands given to each hardware module in order to produce a given sheet; for example, a feeder such as 14*a* may be instructed to draw an A4 sheet, the marker instructed to route the sheet for a simplex print, and the stacker/stapler instructed to accept the sheet. This capability is then sent on to schedule builder 102, as shown at step (3).

Schedule builder 102 has the general function of creating a schedule of all necessary pitches to perform the job, such as sf-s-d, which is a list of "timed capabilities". Note that the timed capabilities include, in addition to the simplex and duplex outputs shown in the basic capability, the front image f for each duplex and, as necessary, a number of blank pitches as well. As such, schedule builder 102 accesses and refers to a table known as "schedule tree" 112, as shown at step (4). Schedule tree 112 is an ongoing table of all "possible directions" a developing schedule may take within a certain time window, as explained in detail in the cross-referenced patent application. In order to develop a list of a number of possible extensions given a particular simplex or duplex print to be output, the schedule builder 102 uses the transition table 60, the function of which has been described above, to derive, in step (5), a certain number possible new schedules given an ending to a given schedule and the desired extensions necessitated by the addition of a simplex or duplex block. Every path from an initial extension point in a developing schedule to any one of the most recent extensions is a schedule for every capability seen by schedule builder 102 up to that point; as will be explained in detail below, there may be generated all possible extensions to a given schedule given the most recently requested simplex or duplex block, or only a subset of all possible extensions. At step (6), these extensions are applied to the schedule tree 112, to build up a new generation of possible schedules forming "leaves" of the tree, as will be explained in detail below.

Steps 3–6 in FIG. 4 cycle for every capability requested by the capability selector 100, that is, for every simplex or duplex sheet requested by the user. At this point, in response to the latest simplex or duplex sheet requested to be printed by the user, there will be a number of possible schedules generated in schedule tree 112 that will yield the desired output, and the remaining issue becomes selecting which of these possible schedules should be chosen for actual implementation. At step (7), the schedule builder 102 tests all available extensions within schedule tree 112, and then chooses an "optimal" schedule given its specific purposes, using selection techniques which will be described in detail below. At step (8), the schedule builder 102 sends on the selected extension, representing what it considers the optimal schedule, to schedule executor 104, which then instructs the marker 106 to print out a desired sequence of images on a desired set of simplex and duplex prints, according to the image data.

Figure 5:
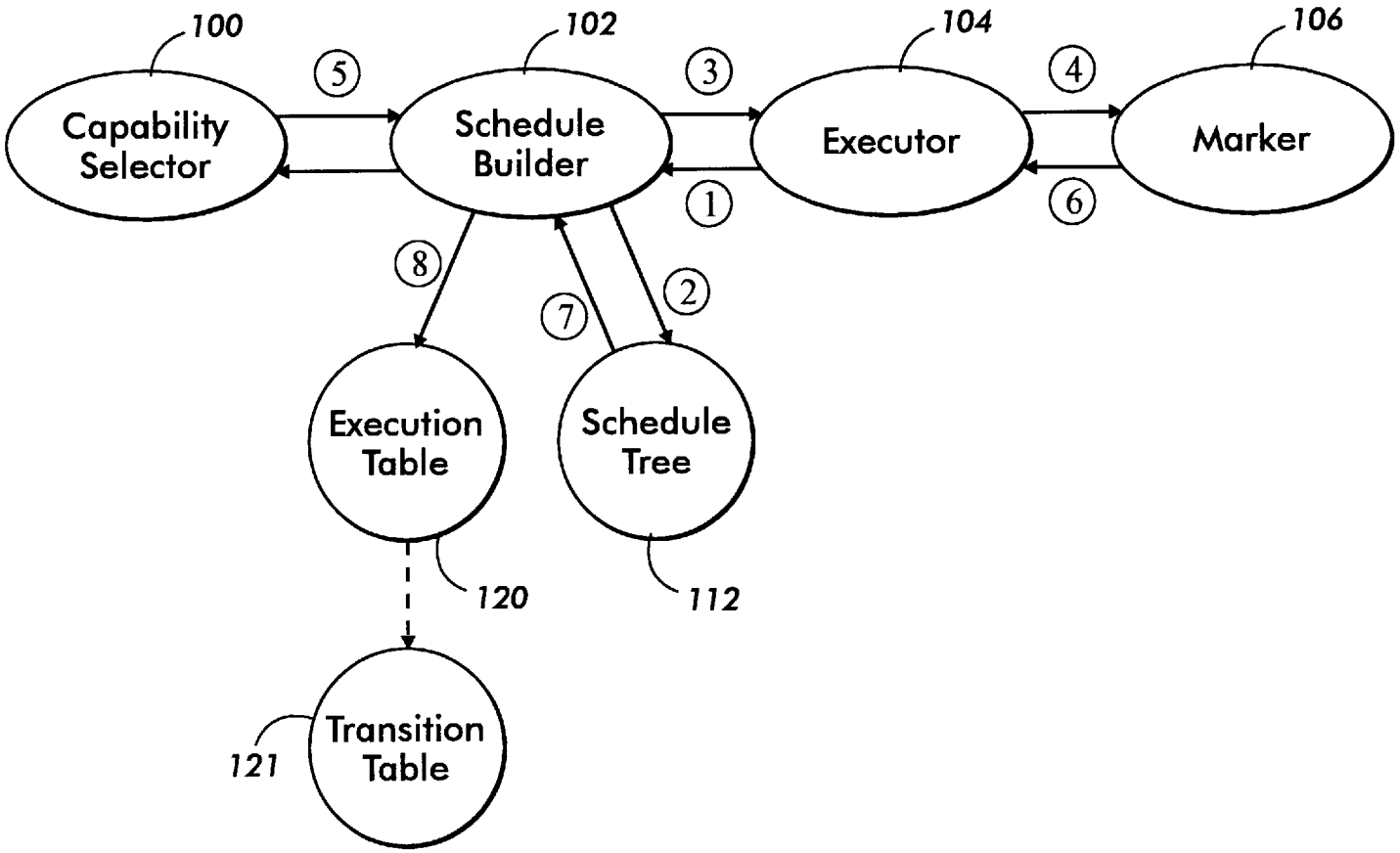
FIG. 5 is a diagram of various software entities according to the control system of the present invention, illustrating the interaction thereof to enable the "propose-accept-confirm" control of the printer hardware.

According to a practical embodiment of a duplexing digital printing apparatus, accommodation must be made for those situations in which, for whatever reason, in the course of scheduling and outputting a desired print job, one or more pitches or images become practically impossible to output at a particular time, according to the schedule. FIG. 5, which shows many of the same software entities shown in FIG. 4, illustrates the details of the "propose-accept-confirm" (PAC) protocol according to one embodiment of the present invention. The process illustrated in FIG. 5 should be understood as operating in addition to, and simultaneous with, the basic steps shown in FIG. 4. First, in step (1), the schedule executor 104 asks schedule builder 102 for the next timed capability not yet delivered to the executor 104. (In some possible embodiments, the executor 104 could receive the group of timed capabilities associated with the next output sheet, i.e. an f and a d.) The schedule builder 102 then selects the most desirable extension from schedule tree 112, at step (2), and sends from this the next timed capability, at step (3), to schedule executor 104. (It will be noted that steps 1–3 in FIG. 5 are the same as steps 4–6 in FIG. 4.)

Having received the newest extension to the schedule, the schedule executor 104 then "proposes" the new portions of the schedule to marker 106, at step (4). It will be noted that there is a fixed-length, moving time window between the final creation of the schedule, and the various hardware activities which cause the schedule to be carried out by the marker 106; this time window is on the order of a few seconds. While this is happening, the system can receive instructions, such as at step (5), for printing a subsequent sheet. If it happens that the marker 106, having monitored, for example, the presence of a blank sheet in the desired place on the paper path, or the availability of the particular image to be printed in rasterized form, accepts the proposed schedule, such as at step (6) in FIG. 5, the acceptance is sent back to schedule builder 102, which, at step (7), "prunes" the schedule tree 112, in a manner which is described in the cross-referenced patent application, and simultaneously records the accepted revision to the schedule in an "execution table" 120 using an execution transition table 121, which will be described in detail below.

E. Execution States

According to a preferred technique of amending a schedule while the printing apparatus is in operation, an evolving list of what is known as an "execution states" can be maintained simultaneously with the optimized schedule that is being built. An execution state is associated with the executed schedule, that portion of a developing schedule which has been proposed and confirmed. The executed schedule differs from a developing schedule in that, while the building of the optimized schedule allows the builder of the schedule to "reach back" such as to assign an f block to be a certain number of pitches before a d block placed at the end of the schedule, the executed schedule evolves in a manner which can only look forward in real time or "page-feed" order, at the "horizon" of upcoming pitches as they become available. As with developing schedules, the executed schedule has a state which reflects a configuration of timed capabilities over a window of time. The difference is the order in which new blocks appear when effecting a transition from one state (schedule ending within a number of pitches representing the reachback) to another. If a job specifies an output order of $sd_1d_2$, execution state transitions would have to be based on a sheet-feed order $d_1d_2s$, because each d implies an f which would precede the s. (As described in the claims herein, the sequence of blocks which are proposed to marker 106 can be said to occupy a "schedule space," and the sequence of blocks which are accepted by the marker are said to occupy an "execution space." Practically these "spaces" are any type of memory which defines "pitches" into which the various blocks can be entered, such as pitch spaces 54 in memory 52, and execution table 120 described above.)

Another way to define the difference between a developing schedule and the executed schedule is that, whereas the schedule is first developed as described above, and then the timed capabilities (instructions to print s, f, and d images) are proposed to the marker 106, the executed schedule can add these blocks only after the particular image has been accepted by marker 106. The execution state reflects the most recent confirmed capabilities over a period of time equal to the scheduling reachback. Whenever new capabilities are confirmed by marker 106, these capabilities are added to the executed schedule, thereby extending it, and the window is shifted into the future, resulting in a new state. This is also true for the scheduling state: whenever a capability is scheduled, the time window is shifted, giving a new state. As will be shown, when the scheduling tables are augmented by blank transitions, this execution state can be used to quickly reset the scheduling state when a capability proposal is rejected.

As pointed out with reference to transition table 60 above, there can only be a finite number of possible endings to a schedule within a reachback; a reachback of five pitches for a duplex printer, for example, may mean that there are only sixteen possible endings to a schedule, and that the addition of a simplex or duplex block to one of the sixteen possible endings merely created a new ending which is one of the sixteen possible endings, each ending accessible by an index number such as from 1 to 16. The same principle of exploiting the finite number of possible schedule endings within a reachback can be applied to execution states as well: as with the endings of schedules. There is a finite number of possible endings to an execution state within a reachback, and the addition of an f, s, or d block to one of these endings (as such a block is accepted) will merely convert the ending to a different one of the endings which can be quickly cross-referenced, such as by an index number, in a transition table such as indicated as 121 in FIG. 5, functioning generally as described above with reference to transition table 60.

In the normal course of scheduling simplex and duplex prints, when there are no rejections of proposed schedules, the schedule and the execution states are maintained concurrently by the schedule builder 102. The schedules are read and modified by consulting the transition table 60 throughout the scheduling cycle. The execution tables are modified during the execution cycles, based on feedback from the executor 104 that a proposed schedule was confirmed by marker 106.

An example of the different ways that the optimized and executed schedules evolve is shown in FIG. 6. In this example, it is desired to print first a simplex sheet and then two duplex sheets $d_1$ and $d_2$, for a total desired output of $sd_1d_2$. In the left column is shown how an optimized schedule would develop within schedule builder 102, such as by using a reachback technique: it will be noted that the first s block appears only at three offsets (i.e. deliberately-placed blank pitches which can be used by later-scheduled blocks) from the beginning of the job; that is, in effect the developing schedule has been able to "reach back" and decide to print out the front sides $f_1$ and $f_2$ before printing the first simplex sheet s. In contrast, a developing executed schedule does not have the option of being able to place front blocks such as $f_1$ $f_2$ before the printing of other pitches; the execution table must schedule pitches as they are accepted by marker 106. So, after the schedule builder 102 obtains the optimal schedule for the job $f_1$ $f_2$-s $d_1$ $d_2$, the marker 106 will begin scheduling the pitches, by instructing the hardware and image-processing software to arrange the page images for this schedule in the scheduled order. As shown on the right side of the table, the executed schedule must first record the first required page image $f_1$, which must necessarily be followed by $d_1$ four pitches later. Then the executed schedule must record the $f_2$ image right after the $f_1$ image, and also the corresponding $d_2$ image, and so forth, until the optimized schedule is duplicated in the executed schedule.

To illustrate the above-mentioned state reset, if the $f_2$ image is rejected by marker 106, the schedule builder can refer back to the developing schedule to find the last place in the schedule before the invalid $f_2$ pitch is required, which in this case is the step $f_1$ - - $sd_1$. The state associated with the last acceptable portion of the schedule is then amended to take into account the invalid pitches, becoming representative of $f_1$x-$sd_1$, the x indicating that the pitch cannot be used (the pitch that would have accepted the $d_2$ image can be used for another block later, however). Then, as described above, this amended state can be applied to the transition table 60, to find a new schedule by which $f_2$ - - - $d_2$ can be added to $f_1$x$sd_1$. In this case one possible amended schedule could be $f_1$x $f_2$sdx$d_2$; however, in certain architectures of duplex printers, an fs sequence may be impermissible. In this case the new amended schedule would have to be simply to add the $f_2$- - -$d_2$ to the ending, for a new schedule of $f_1$x - $sd_1f_2$ - - - $d_2$. Considering the x in the schedule is in effect a blank pitch, this amended schedule is actually $f_1$- -$sd_1f_2$- - -$d_2$, which is the most optimal schedule which avoids the invalid pitch.

The execution state is key to the process of identifying the new scheduling state. According to one aspect of the present invention, upon the rejection of a proposed schedule by marker 106, the rejected schedule is unwound to be consistent with the last valid execution state. This means that blocks must be removed in reverse order from the schedule until it contains none of the blocks for the rejected capability. Then, the last valid execution state is compared to the state of the unwound schedule, without taking into account the invalid pitch. In this case, the last execution state is $f_1$ - - - $d_1$ while the state of the unwound schedule is $f_1$ - - $sd_1$. If the last valid execution state (within a predetermined number of pitches at the end of the schedule, the predetermined number typically relating to the length of the reachback) and unwound schedule state are the same, then the last valid execution state is used as the reference point from which to begin rescheduling.

If the last valid execution state and the unwound schedule state are not the same, according to this aspect of the present invention, the schedule state, and not the last valid execution state, is used as the reference point: that is, if a transition table is being used to determine the next schedule or execution state, the transition table 60 for the schedule state is used as the reference point from which to begin scheduling. In either case, the new scheduling state takes into the account the invalid pitch, being the result of applying a blank transition to the reference point. The scheduling transition table 60 provides the blank transition when the reference point is a scheduling state; otherwise, the execution transition table 121 is used. Thus, according to this method, and as shown in the lower portion of FIG. 6, the unwound schedule state represents the configuration $f_1$- - -$d_1$, which with the invalid pitch becomes $f_1$x-$sd_1$.

The example shows a special case of this technique, which must be taken into account in many practical designs of a duplex printer, occurring when the marker 106 rejects a proposed schedule but there exists another simplex or duplex block which has been scheduled but not yet proposed at the time a previous block has been rejected. Had the last valid execution state been used to begin re-scheduling, the s block would have been forgotten, because it does not appear in the last valid execution state, $f_1$---$d_1$. Using the unwound schedule state, and not last valid execution state, when the two are not the same, thus prevents some intermediate block which has been scheduled but not yet proposed, such as the s in this example, from being "forgotten" when re-scheduling is required. The schedule builder 102 needs to record the states of schedules that can be reached by unwinding only where they represent a configuration of blocks with an intermediate block; if no state has been recorded for the unwound schedule, the schedule builder automatically resets from the execution state. Therefore, the amount of overhead for handling this situation is proportional to how often it occurs.

F. End-of-job Scheduling

A special case of the above-described scheduling system occurs in situations when the schedule builder is still outputting schedules for the marker 106, when no further job requests are entering the system through capability selector 100. Although another job may enter the system at some random time in the future, a problem arises that pitches, that is, opportunities to place a particular image on the side of a sheet at a particular time, will pass as the apparatus waits for any further instructions. One embodiment of the present invention therefore proposes providing the schedule builder 102 with a special routine to be activated when no further capabilities are being supplied by capability selector 100.

As an example of the practical difficulty which arises at the end of printing a job, consider a case where an entire job to be printed consists of two duplex sheets, for a schedule of ff - - dd. This ff - - dd will thus remain as the end of a schedule, from which further simplex or duplex blocks (such as from a subsequent job) will be appended. Absent any other control, if a second job, for example printing a two-page duplex d, enters the system through capability selector 100, under the basic rules of scheduling this d could be placed to make a schedule of fffddd. However, if there is a time-lag between the acceptance of the original schedule ff-dd by marker 106 and submission of the duplex second job d, the two-page duplex first job may have already been printed before the new d was received; therefore, it would have been impossible to place the new front side in one of the blank pitches of the previous job because the duplex sides dd may have already been printed, and therefore printing the new front side before them would be a physical impossibility.

Figure 7:
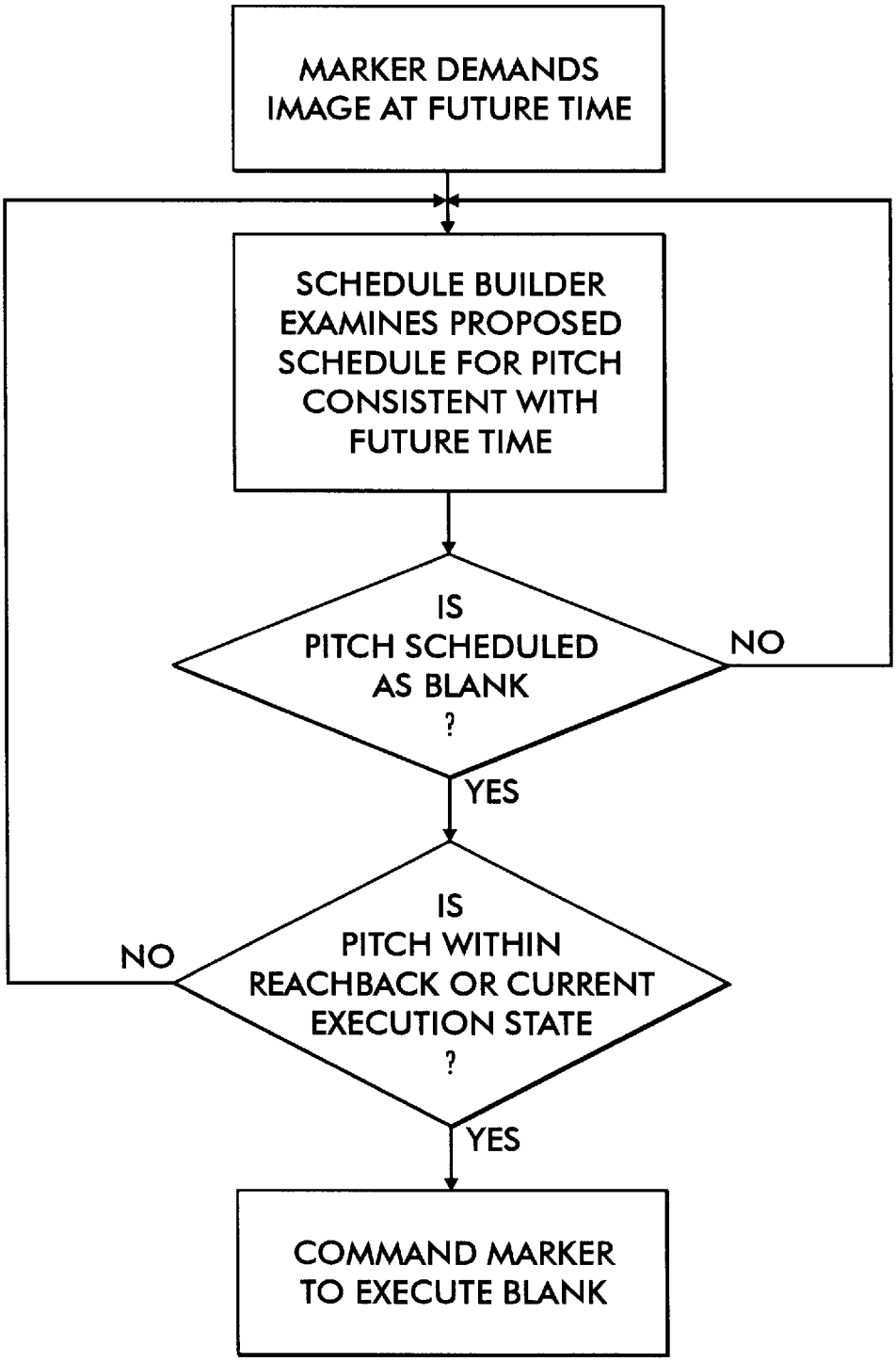
FIG. 7 is a flow-chart of an end-of-job scheduling technique according to one aspect of the present invention.

In order the rectify the problem of committing images to pitches, one aspect of the present invention proposes a system for supplying what are in effect invalid pitches (that is, instructing the marker 106 to execute a blank image) when it is no longer physically possible to access a particular pitch due to the passage of time. FIG. 7 is a flow chart illustrating an end-of-job routine according to this aspect of the present invention. With reference to the Figure, when marker 106 in effect requests an image to be placed on the photoreceptor at a particular fixed time in the future, the schedule builder 102 must examine the proposed schedule for a pitch, for example, four pitches in the future, consistent with this demand from marker 106. (Whether the marker 106 in fact makes a software request for this new image, or the schedule builder 102 or executor 104 in effect pushes requests for images forward, is immaterial.) According to the routine of the present invention, if the pitch that will be available to the printing hardware a certain fixed period of time in the future is scheduled as a blank pitch, and this pitch is within the reachback of the current execution state, the schedule builder 102 amends the state representative of the end of the schedule by making a blank execution transition. This blank transition effectively prevents a block from being scheduled in that pitch anytime in the future since the amended state will be used as the root scheduling state when a new job enters the system.

G. Generalizing the Claimed Methods

As used in certain of the claims herein, print sheets which are output by the apparatus such as 10 will be referred to as either "simplex" or "complex" documents. In the present description of a preferred embodiment of the present invention, the method of the present invention is applied to the creation of duplex sheets, that is, sheets having a first image printed on one side and a second image printed on another side. However, in other possible embodiments of certain of the claims hereinbelow, the claimed principles could be applied to other printing tasks in which multiple images are printed on a sheet, such as when different primary-color images are printed on the same side of a sheet to yield a full-color image. For this reason, what is described as "duplex blocks" or "duplex sheets" in the specification can be generalized to "complex blocks" in the claims.

To further generalize certain of the concepts claimed below, a "complex block" can refer not only to a duplex block which describes the steps of printing a first side then a second side of an image, with the two printing steps being spaced by a certain number of "blank pitches," but rather a "complex block" can be any block which describes a routine carried out by hardware which requires the provision of blank pitches or other time gaps, either to re-feed a sheet into a printing apparatus, or to take into account a time lag, for example, when a sheet is moved from one printing module (such as a monochrome printer) to another module (such as a full-color printer). Thus, while a basic "duplex block" as described in the present embodiment will look like f - - - d, a "complex block" could look something like - - - p, where p represents some generalized printing step, and the preceding dashes represent a necessary time lag for a given sheet to be transported to a particular printing module; such a situation may arise, for example, if a sheet of a particular desired color or weight must be retrieved from a remote feeding module.

Alternately, in a multi-pass color printing situation, if a sheet or photoreceptor pitch must be recirculated within a machine to receive another CMYK color separation to create a full-color image, a block may look something like c - m - y - k, with each letter representing printing of a given separation and the dashes representing pitches available for printing of separations of other sheets. In any case, whatever the appearance of the blocks, the above-described methods for scheduling printing operations in real time can be applied. In brief, while the illustrated embodiment of the present invention shows the technique of the present invention applied to the scheduling of simplex and duplex prints, the claims can be applied to other scheduling contexts, and the "shape" of the various scheduling blocks will be adapted accordingly.

Even more generally, the basic claimed methods can be applied to any automated process, such as in a manufacturing context, in which repeated processes must be scheduled in an optimal or near-optimal way. In a general case, there may be "operation blocks" which refer to a specific operation, such as molding, painting, firing, stamping etc., "time lag blocks," such as the dashes above, which represent required time lags which may be available for processing other objects in the process, and "restricted blocks," such as the x blocks above, which indicate times in which a process is not going on, but which are not available for other operations. Thus, to take an example wherein a p block represents dipping a ceramic cup into some stain, a q block represents firing the cup, and where there must be a time lag between the two steps, a complex block may look like p - - - q. If the cup is to be decorated with a decal which is applied after staining but still having the same time-lag before firing, if the decal-applying step is given as r, a complex block may look like pr - - - q. (If the decal required an even longer time-lag before firing, the block may look like p r - - - q.)It can thus be seen that a long series of p - - - q (for no-decal cups) and pr - - - q blocks (for decal cups) can be scheduled together, so that a decal cup $q_1$ followed by a no-decal cup $q_2$ could be scheduled as $p_1r_1p_2$ - - $q_1q_2$.

To further complicate this example, consider a case where the fired cup has to remain in the kiln for one "pitch" before it is removed, and therefore the kiln cannot be used immediately after a firing step; in such a case a job for a no-decal cup would look like p - - -qx, x being a block signifying that no other block can be scheduled there. With this constraint the $q_1q_2$ job above will look like $p_1r_1$ - $p_2q_1xq_2x$. Even in this non-printing context, the above-described methods find utility in optimizing a schedule of operations and taking into account real-time situations in which a requested operation (having the decal ready in time, for example) but prove to be unavailable after it is scheduled.

While the invention has been described with reference to the structure disclosed, it is not confined to the details set forth, but is intended to cover such modifications or changes as may come within the scope of the following claims.

We claim:

1. A method of developing a schedule for operations in an apparatus for outputting prints, comprising the steps of:

providing a schedule space defining a series of pitches;

for a print to be output, entering to the schedule space a block representative of the apparatus outputting the print;

proposing to the apparatus a series of operations according to a schedule of blocks in the schedule space, each block corresponding to a pitch to be executed at a predetermined time in the future;

providing an execution space defining a series of pitches;

if a proposed operation is accepted by the apparatus, entering a block representing the operation to the execution space in real time; and if a proposed operation is rejected by the apparatus;

identifying a pitch in the execution space consistent with the last operation accepted by the apparatus;

removing blocks in reverse order from the series of operations proposed to the apparatus until the last pitch in the schedule space corresponds to the identified pitch in the execution space;

entering to the schedule space an invalid pitch consistent with the pitch corresponding to the proposed operation that was rejected by the apparatus; and entering blocks to the schedule space consistent with operations to be proposed after the invalid pitch.

2. The method of claim 1, in an apparatus for outputting simplex prints having one image thereon and complex prints having a plurality of images thereon, the entering step including the steps of for each simplex print to be output, entering to a pitch in the schedule space a simplex block indicative of printing the simplex print;

for each complex print to be output, entering to the schedule space a complex block indicative of printing the complex print, the step of providing the complex block including entering to a first pitch in the schedule space a first block indicative of printing a first image, entering to a second pitch in the schedule space a final block indicative of printing a second image, and entering to at least one pitch in the schedule space a blank pitch indicative of a time delay between the first block and the final block, the blank pitch being available for entry of a further block therein.

3. The method of claim 1, further comprising the steps of providing a execution transition table for creating new end sequences in the execution space, the execution transition table being a table of possible end sequences at an end of the execution space, each possible end sequence being referred to by an index number;

for every operation accepted by the apparatus, causing the execution transition table to generate a new end sequence consistent with the accepted operation by referring to an index number of the existing end sequence and a type of operation accepted by the operation.

4. A method of developing a schedule for operations in an apparatus for outputting prints, comprising the steps of:

providing a schedule space defining a series of pitches;

for a print to be output, entering to the schedule space a block representative of the apparatus outputting the print;

proposing to the apparatus a series of operations according to a schedule of blocks in the schedule space, each block corresponding to a pitch to be executed at a predetermined time in the future;

providing an execution space defining a series of pitches;

if a proposed operation is accepted by the apparatus, entering a block representing the operation to the execution space in real time;

comparing a predetermined number of pitches in the execution space before the last operation accepted by the apparatus to corresponding pitches in the schedule space;

if the compared pitches in the execution space and schedule space are not identical, scheduling a new end sequence by referring to an end sequence consistent with the last valid operation in the schedule space and a type of operation to be proposed after the invalid pitch.

5. A method of developing a schedule for operations in an apparatus for outputting simplex prints having one image thereon and complex prints having a plurality of images thereon, comprising the steps of:

providing a schedule space defining a series of pitches;

for a print to be output, entering to the schedule space a block representative of the apparatus outputting the print;

proposing to the apparatus a series of operations according to a schedule of blocks in the schedule space, each block corresponding to a pitch to be executed at a predetermined time in the future, a time period between scheduling of a pitch in the schedule and execution of an operation in the schedule being defined as a time range;

if there is no block scheduled in a given pitch entering the time range, preventing scheduling of a block in said given pitch.

6. The method of claim 5, the entering step including the steps of for each simplex print to be output, providing to a pitch in the schedule space a simplex block indicative of printing the simplex print;

for each complex print to be output, providing to the schedule space a complex block indicative of printing the complex print, the step of providing the complex block including providing to a first pitch in the schedule space a first block indicative of printing a first image, providing to a second pitch in the schedule space a final block indicative of printing a second image, and providing to at least one pitch in the schedule space a blank pitch indicative of a time delay between the first block and the final block, the blank pitch being available for entry of a further block therein.

* * * * *